US010508429B2

(12) United States Patent
Casey et al.

(10) Patent No.: US 10,508,429 B2
(45) Date of Patent: Dec. 17, 2019

(54) THRESHOLD DRAIN SYSTEM AND METHOD

(71) Applicant: ACO LIMITED, Auckland (NZ)

(72) Inventors: Paul Casey, Auckland (NZ); Matthew Gordon Howes, Auckland (NZ)

(73) Assignee: ACO SEVERIN AHLMANN GMBH & CO. KG, Budelsdorf (DE)

( * ) Notice: Subject to any disclaimer, the term of this patent is extended or adjusted under 35 U.S.C. 154(b) by 1 day.

(21) Appl. No.: 16/008,896

(22) Filed: Jun. 14, 2018

(65) Prior Publication Data

US 2018/0363284 A1 Dec. 20, 2018

(30) Foreign Application Priority Data

Jun. 20, 2017 (NZ) ..... 733022

(51) Int. Cl.

| | |
|---|---|
| ***E03F 5/04*** | (2006.01) |
| ***E06B 1/70*** | (2006.01) |
| ***E03F 5/06*** | (2006.01) |
| ***E06B 7/14*** | (2006.01) |
| ***E03F 3/04*** | (2006.01) |

(52) U.S. Cl.

CPC ..... *E03F 5/0407* (2013.01); *E03F 3/046* (2013.01); *E03F 5/06* (2013.01); *E06B 1/70* (2013.01); *E06B 7/14* (2013.01)

(58) Field of Classification Search

CPC ..... E03F 5/0407; E03F 3/046; E03F 5/06; E06B 7/14; E06B 1/70

See application file for complete search history.

(56) References Cited

U.S. PATENT DOCUMENTS 3,089,396 A * 5/1963 Rowland ..... E03F 5/06 210/163
4,387,535 A * 6/1983 Corbo ..... E06B 1/70 49/468

(Continued)

FOREIGN PATENT DOCUMENTS

CA 2751748 A1 * 8/2010 ..... E03F 5/0407
CA 2980891 A1 * 3/2018 ..... E03F 5/0407

(Continued)

*Primary Examiner* — Jessie T Fonseca

(74) *Attorney, Agent, or Firm* — Pearne & Gordon LLP

(57) ABSTRACT

A method of forming a threshold drain 31 is disclosed. The drain 31 extends alongside an exterior wall 4 of a building and is formed in an exterior surface 36. The building has an interior floor 21 with the exterior surface 36 and the interior floor 21 being substantially flush to permit traymobile, wheelchair and invalid access. In a single concrete pour, the drain gutter 31, exterior surface 36, interior floor 21 and a gutter 40 are all formed. The gutter has an exterior side wall 39 which supports a plurality of triangular cantilever arms 43. A support frame 42 having two longitudinally extending rims 51,52 is supported by the arms 43 and releasably receives a grate 32 between the rims 51, 52. The inner rim 51 is spaced from the wall 24 of the building, preferably by 10-12 mm (⅜-½ inch), so as to provide a barrier to moisture in accordance with the Building Code of New Zealand standard set out in Clause E2 External Moisture. The drain 31 is also disclosed.

12 Claims, 5 Drawing Sheets

(56) References Cited

U.S. PATENT DOCUMENTS

| | | | | | |
|---|---|---|---|---|---|
| 5,340,234 | A * | 8/1994 | Rossi | E01C 11/227 | 405/119 |
| 7,637,695 | B1 * | 12/2009 | Akkala | E03F 5/06 | 404/2 |
| 7,686,540 | B2 * | 3/2010 | Urriola | E01C 11/225 | 405/43 |
| 8,769,875 | B1 * | 7/2014 | Scoggins | E06B 1/70 | 49/467 |
| 2009/0097921 | A1 * | 4/2009 | Hetzler | E03F 3/046 | 405/119 |
| 2010/0061805 | A1 * | 3/2010 | Nourian | E03F 3/046 | 405/36 |
| 2015/0275497 | A1 * | 10/2015 | Nyce | E03F 5/0407 | 52/302.1 |
| 2018/0155915 | A1 * | 6/2018 | Meyers | E03F 5/0408 | |
| 2018/0209132 | A1 * | 7/2018 | Dian | E03F 3/046 | |

FOREIGN PATENT DOCUMENTS

| | | | | | |
|---|---|---|---|---|---|
| CA | 3011583 | A1 * | 1/2019 | E03F 5/0407 | |
| DE | 202010002763 | U1 * | 7/2011 | E03F 5/04 | |
| GB | 2364731 | A * | 2/2002 | E06B 1/70 | |
| GB | 2381287 | A * | 4/2003 | E06B 1/70 | |
| GB | 2385877 | A * | 9/2003 | E06B 7/14 | |
| JP | 2000129741 | A * | 5/2000 | | |

* cited by examiner

THRESHOLD DRAIN SYSTEM AND METHOD

FIELD OF THE INVENTION

The present invention relates to drains and, in particular, to threshold drains.

BACKGROUND ART

Threshold drains are used on balconies, and general outdoor areas such as patios and entertainment areas. Threshold drains enable the formed areas outside a building to be made substantially level with the floor levels inside the building. Such an equality of levels ensures safe passage of wheelchairs, traymobiles and other wheeled implements, and invalids and other persons who require the assistance of a walking cane.

A threshold drain also dramatically reduces the risk of surface water penetrating a building via a door threshold, and also collects run-off from doors and windows during storms. The Building Code of New Zealand provides a standard set out in Clause E2 External Moisture which requires that a gap extend between the building wall and the grate of the adjacent threshold drain. Other countries or jurisdictions have equivalent or similar standards.

Hitherto the construction of the threshold drain has required two concrete pours. The first pour forms the drain trench or gutter. Thereafter the support frame for the grate of the drain is installed on the poured concrete. Next a second concrete pour takes place so as to cover the supporting arms of the support frame and build up the exterior concrete surface to the level of the interior floor (less any provision for subsequent pavers to be laid on the exterior concrete surface).

GENESIS OF THE INVENTION

The genesis of the present invention is a desire to simplify the construction of threshold drains by the provision of a threshold drain system which requires only a single concrete pour and thus saves both time and money in the threshold drain construction.

SUMMARY OF THE INVENTION

In accordance with a first aspect of the present invention there is disclosed a drain system for a threshold drain extending alongside an exterior wall of the building, said building having an interior floor and said threshold drain draining an exterior formed surface which is substantially flush with said interior floor, said system comprising:

a drain gutter having a base and two side walls, one of said sidewalls being substantially aligned with said building wall and the other of said sidewalls being spaced from said building wall;

a grate support frame having a pair of elongate rims, said frame being supported by a plurality of cantilever arms each of which is secured to the other side wall of said gutter following formation of said gutter, said frame having a width between said rims which is less than the width of said gutter; and a grate located between said rims and supported by said frame;

whereby a gap is created between said building wall and the rim closer to said building wall, said gap extending alongside said building wall.

In accordance with a second aspect of the present invention there is disclosed a method of forming a threshold drain extending alongside an exterior wall of the building, said building having an interior floor and said threshold drain being formed in an exterior formed surface which is substantially flush with said interior floor, said method comprising the steps of:

in a single concrete pour, forming a drain gutter and said exterior formed surface, said drain gutter having a base and two side walls, one of said sidewalls being substantially aligned with said building and the other of said sidewalls being spaced from said building wall, supporting a grate support frame having a pair of elongate rims by a plurality of cantilever arms, each of said cantilever arms being secured to the other side wall of said gutter after formation thereof, said frame having a width between said rims which is less than the width of said gutter, and supporting a grate on said frame and located between said rims, whereby a gap is created between said building wall and the rim closer to said building wall, said gap extending alongside said building wall.

BRIEF DESCRIPTION OF THE DRAWINGS

A preferred embodiment of the invention will now be described, by way of example only, with reference to the accompanying drawings in which.

DETAILED DESCRIPTION

Figure 1:
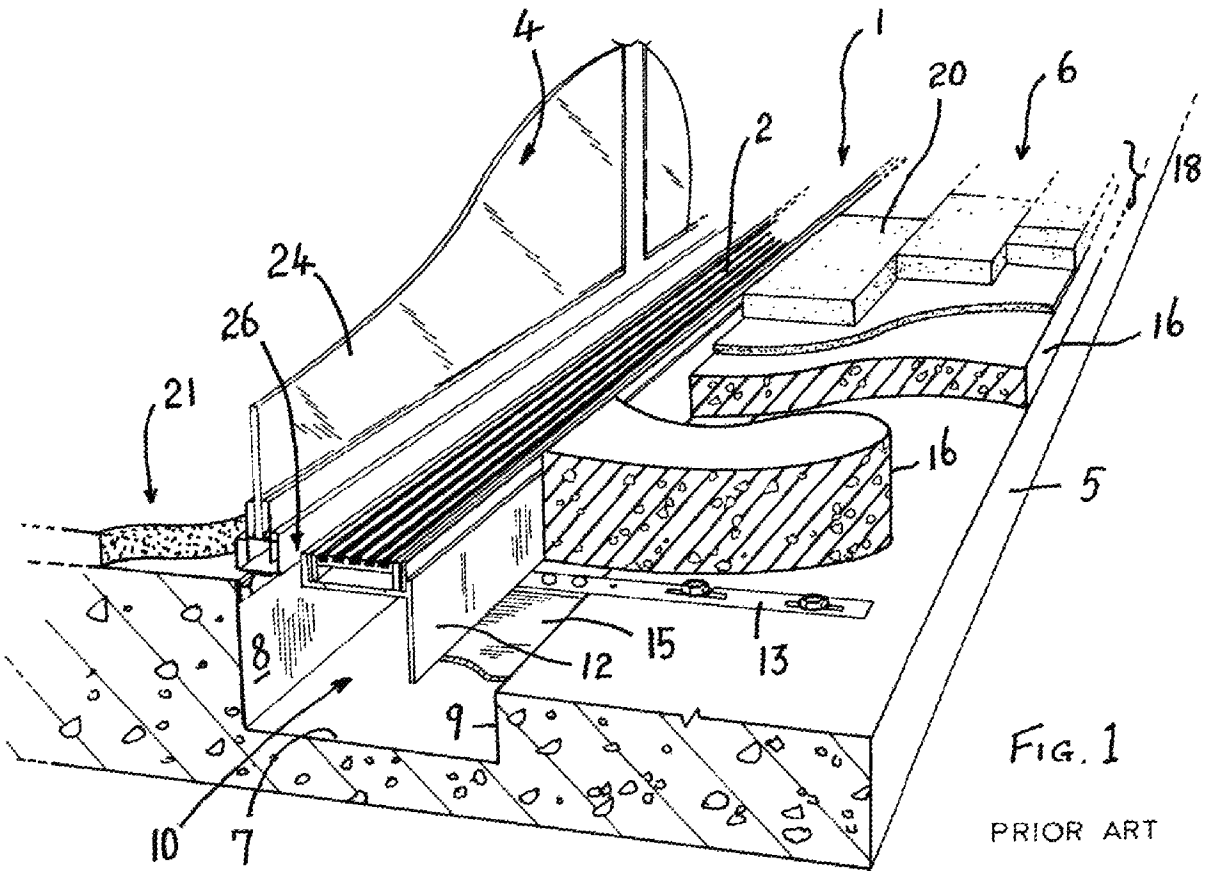
FIG. 1 PRIOR ART
FIG. 1 is a perspective view of a prior art threshold drain.
Figure 2:
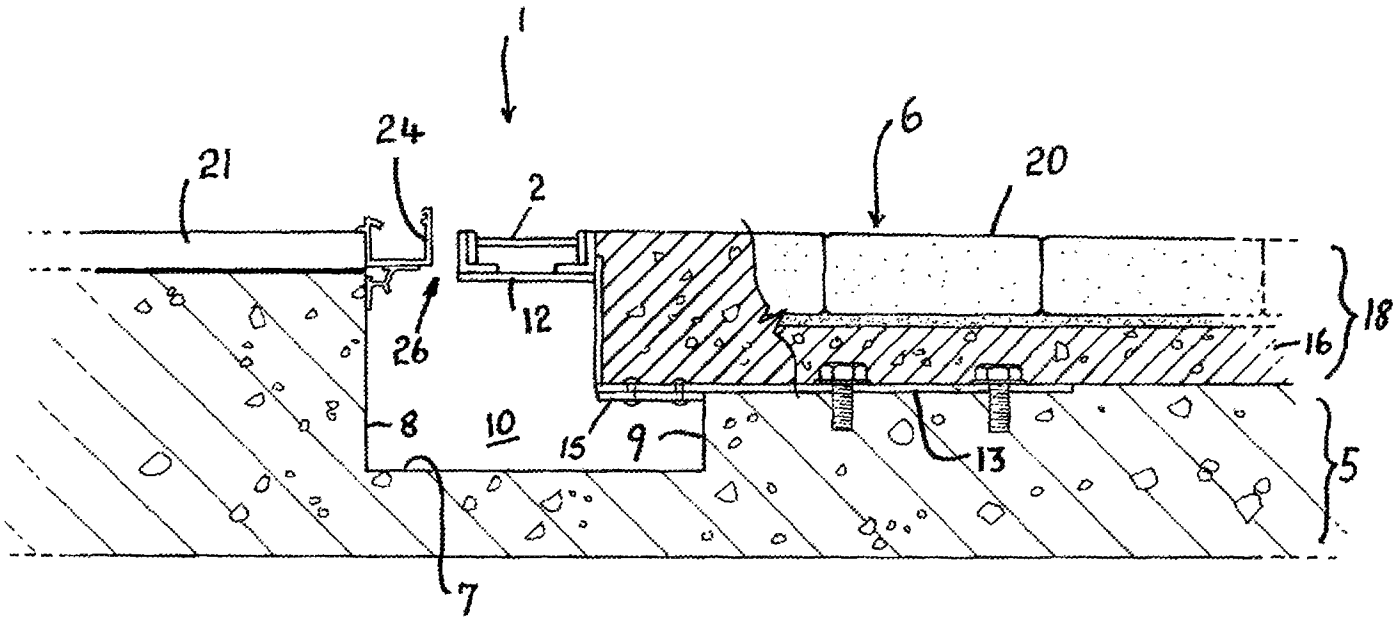
FIG. 2 PRIOR ART
FIG. 2 is a transverse cross-sectional view through the drain of FIG. 1.

As seen in FIGS. 1 and 2, a prior art threshold drain 1 having a grate 2 is formed adjacent a wall 4 of a building. Part of the wall 4 and the lower portion 5 of a balcony or other exterior formed surface 6 are formed by a first concrete pour. The first concrete pour also forms the base 7, interior side wall 8, and part of the exterior side wall 9 of the gutter 10 of the threshold drain 1.

A vertical frame 12 has a number of horizontal supporting arms 13 which, as illustrated, are bolted to the lower portion 5. A formwork strip 15 is secured to the underside of the supporting arms 13. Thus the vertical frame 12 and formwork strip 15 provide a means of containment for the concrete 16 of a second concrete pour which provides the upper portion 18 of the exterior formed surface 6 and the remainder of the exterior side wall 9.

In one arrangement the exterior formed surface 6 is provided by pavers 20 installed on a thin layer of sand, in which case the concrete 16 has an upper surface which is below the grate 2 by approximately the height of the pavers 20. Alternatively, if the concrete formed by lower portion 5 and upper portion 18 is intended to finish the exterior formed surface 6, then the concrete 16 is levelled off, or screeded, flush with the grate 2 and thus substantially flush with the interior floor 21.

In the particular arrangement illustrated, part of the wall 4 is provided by means of a sliding glass door 24 which opens onto the exterior formed surface 6. As a consequence, the sliding glass door 24 can be opened and ingress and egress between the interior of the building 4 and the exterior formed surface 6 can be achieved for tray mobiles, wheelchairs, invalids with walking canes, and the like because both the interior and exterior surfaces are substantially flush. In addition, there is a gap 26 which extends between the wall 4 and the grate 2 and this provides a barrier to moisture in accordance with the above-mentioned Building Code of New Zealand standard set out in Clause E2 External Moisture.

Accordingly, the prior art arrangement described above complies with the standard but requires two concrete pours which must, of necessity, take place on different days. Accordingly the procedure required to build the prior art arrangement described above is time-consuming and thus expensive.

Figure 3:
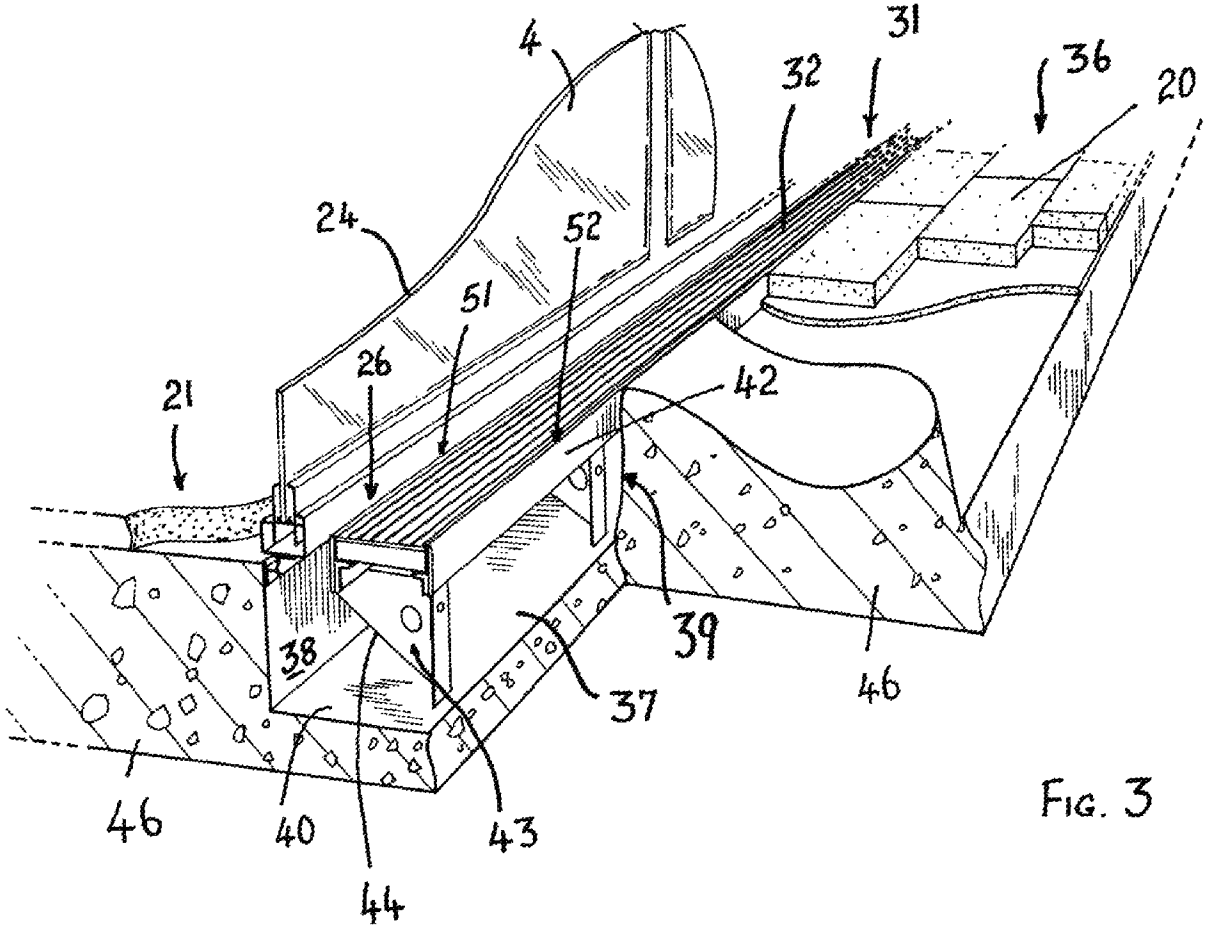
FIG. 3 is a perspective view of a threshold drain in accordance with a preferred embodiment of the present invention.
Figure 4:
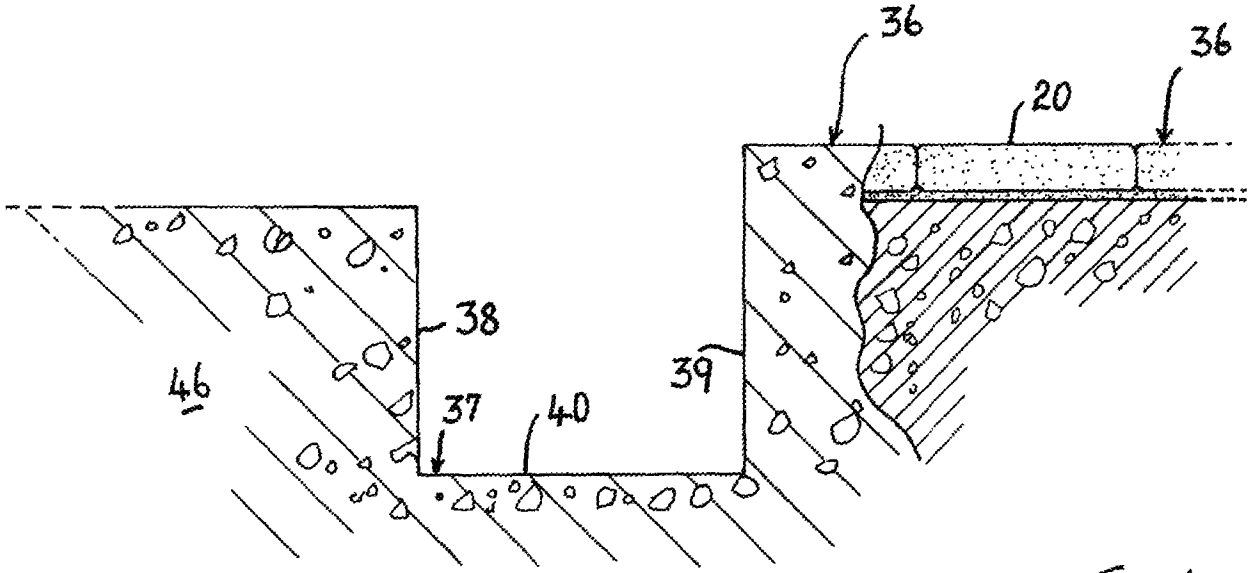
FIG. 4 is a transverse cross-sectional view through the drain of FIG. 3 prior to installation of the threshold drain.
Figure 5:
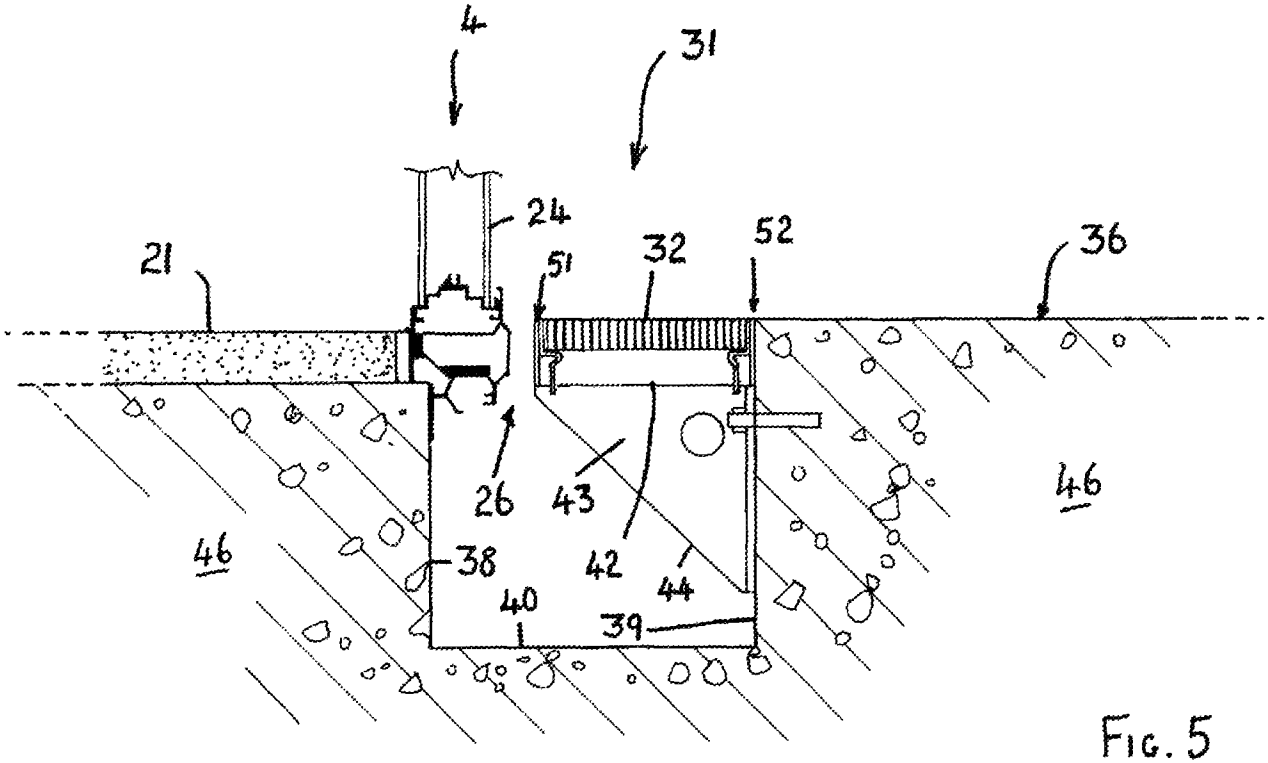
FIG. 5 is a transverse cross-sectional view through the drain of FIG. 3 after installation of the threshold drain.

In accordance with a preferred embodiment of the present invention, as illustrated in FIGS. 3-5, a threshold drain 31 which also complies with the above-mentioned standard is provided. As seen in FIGS. 3-5, the threshold drain 31 has a grate 32 and, as before, is formed adjacent the wall 4 of a building. Part of the wall 4 and all of the balcony or other exterior formed surface 36 are formed by a single concrete pour. The concrete 46 of the single concrete pour also forms the base 37, interior side wall 38, and all of the exterior side wall 39 of the gutter 40 of the threshold drain 31. Preferably the gutter 40 is approximately 200 mm (approximately 8 inches) wide.

A support frame 42 has a plurality of triangular cantilevered arms 43 which, as illustrated, are bolted to the exterior side wall 39 of the gutter 40 after the single concrete pour has taken its initial set. It will be seen that the triangular arms 43 have a first vertical edge which is secured to the sidewall 39, a second horizontal edge which supports the grate 32, and a hypotenuse 44 which does not obstruct the gutter 40. The support frame 42 also has two rims 51, 52 between which the grate 32 is retained.

Either the exterior formed surface 36 is provided by pavers 20 installed on a thin layer of sand, in which case the concrete 46 of the single concrete pour has an upper surface which is below that of the grate 32 by approximately the height of the pavers 20. Or, alternatively, if the concrete 46 is intended to finish the exterior formed surface 36, then the concrete 46 is levelled off, or screeded, flush with the grate 32 and thus substantially flush with the interior floor 21.

Again, part of the wall 4 is provided by means of a sliding glass door 24 which opens onto the exterior formed surface 36. As a consequence, the sliding glass door 24 can be opened and ingress and egress between the interior of the building and the exterior formed surface 36 can be achieved for tray mobiles, wheelchairs, invalids with walking canes, and the like, because both the interior and exterior surfaces are substantially flush. In addition, as before there is a gap 26 (of at least 10 mm and preferably 12 mm width) (approximately ⅜-½ inch) which extends between the wall 4 and the grate 32. This gap 26 provides a barrier to moisture in accordance with the above-mentioned Building Code of New Zealand standard set out in Clause E2 External Moisture.

A particular advantage of the preferred embodiment illustrated in FIGS. 3-5 is that there is only a requirement for a single concrete pour and so the installation of the threshold drain 31 is quick and easy. Furthermore, the arrangement lends itself to retrofitting where a suitable existing gutter 10, 40 is provided. This is unable to be easily achieved with the prior art system and method.

Preferably the grate 32 is able to be removed from the frame 42 since it is retained therein by means of a resilient snap fit inter-engagement. A range of grates 32 having a variety of materials and slot configurations is able to be provided.

The foregoing describes only one embodiment of the present invention and modifications, obvious to those skilled in the drainage arts, can be made thereto without departing from the scope of the present invention.

The term "comprising" (and its grammatical variations) as used herein is used in the inclusive sense of "including" or "having" and not in the exclusive sense of "consisting only of".

The invention claimed is:

1. A drain system for a threshold drain extending alongside an exterior wall of the building, said building having an interior floor and said threshold drain draining an exterior formed surface which is substantially flush with said interior floor, said system comprising:

a drain gutter having a base and two sidewalls, one of said sidewalls being substantially aligned with said exterior wall and the other of said sidewalls being spaced from said exterior wall;

a grate support frame having a pair of elongate rims, said frame being supported by a plurality of cantilever arms each of which is secured to the other sidewall of said gutter following formation of said gutter, said frame having a width between said rims which is less than the width of said gutter; and a grate located between said rims and supported by said frame;

whereby a gap is created between said exterior wall and the rim closer to said exterior wall, said gap extending alongside said exterior wall.

2. The system as defined in claim 1, wherein each of said cantilever arms is substantially a right triangle having a first substantially vertical edge secured to said other sidewall, having a second substantially horizontal edge supporting said rims, and a third edge forming an hypotenuse.

3. The system as defined in claim 1, wherein said grate is releasably located between said rims.

4. The system as defined in claim 1, wherein said drain gutter is formed from poured concrete and said other gutter sidewall is poured to substantially the height of said interior floor during formation of said drain gutter.

5. The system as defined in claim 1, wherein said exterior formed surface is selected from the class consisting of a concrete slab, and pavers laid above a concrete slab.

6. The system as defined in claim 5, wherein the height of said other gutter sidewall is less than the height of said interior floor by the thickness of pavers which are intended to be laid above poured concrete.

7. The system as defined in claim 1, wherein the width of said drain gutter is approximately 200 mm and the width of said gap is at least 10 mm.

8. A method of forming a threshold drain extending alongside an exterior wall of the building, said building having an interior floor and said threshold drain being formed in an exterior formed surface which is substantially flush with said interior floor, said method comprising the steps of:

in a single concrete pour, forming a drain gutter and said exterior formed surface, said drain gutter having a base and two sidewalls, one of said sidewalls being substantially aligned with said building and the other of said sidewalls being spaced from said exterior wall, supporting a grate support frame having a pair of elongate rims by a plurality of cantilever arms, each of said cantilever arms being secured to the other sidewall of said gutter after formation thereof, said frame having a width between said rims which is less than the width of said gutter, and supporting a grate on said frame and located between said rims, whereby a gap is created between said exterior wall and the rim closer to said exterior wall, said gap extending alongside said exterior wall.

9. The method as defined in claim 8, including the further steps of forming each of said cantilever arms as a substantially right triangle having a first substantially vertical edge, a second substantially horizontal edge, and a third edge forming an hypotenuse, securing said first substantially vertical edge to said other sidewall, and supporting said rims by said second substantially horizontal edge.

10. The method as defined in claim 8, including the further step of releasably locating said grate between said rims.

11. The method as defined in claim 8, wherein said exterior formed surface is selected from the class consisting of a concrete slab, and pavers laid above a concrete slab.

12. The method as defined in claim 8, wherein the width of said drain gutter is approximately 200 mm and the width of said gap is at least 10 mm.

* * * * *